US005614816A

United States Patent [19]

Nahas

[11] Patent Number: 5,614,816

[45] Date of Patent: Mar. 25, 1997

[54] LOW VOLTAGE REFERENCE CIRCUIT AND METHOD OF OPERATION

[75] Inventor: Joseph J. Nahas, Austin, Tex.

[73] Assignee: Motorola Inc., Schaumburg, Ill.

[21] Appl. No.: 560,876

[22] Filed: Nov. 20, 1995

[51] Int. Cl.[6] ..... G05F 3/16

[52] U.S. Cl. ..... 323/316; 323/907; 323/315; 327/539

[58] Field of Search ..... 323/313–316, 323/907; 327/539

[56] References Cited

U.S. PATENT DOCUMENTS

| | | | |
|---|---|---|---|
| 3,617,859 | 11/1971 | Dobkin | 323/4 |
| 4,313,082 | 1/1982 | Neidorff | 323/312 |
| 4,368,420 | 1/1983 | Kuo | 323/303 |
| 4,375,595 | 3/1983 | Ulmer et al. | 307/297 |
| 4,849,684 | 7/1989 | Sonntag et al. | 323/313 |
| 4,896,094 | 1/1990 | Greaves et al. | 323/314 |
| 4,935,690 | 6/1990 | Yan | 323/314 |
| 4,945,260 | 7/1990 | Naghshineh et al. | 307/296.6 |
| 5,053,640 | 10/1991 | Yum | 307/296.6 |
| 5,144,223 | 9/1992 | Gillingham | 323/313 |
| 5,148,099 | 9/1992 | Ong | 323/314 |
| 5,245,273 | 9/1993 | Greaves et al. | 323/313 |
| 5,325,045 | 6/1994 | Sundby | 323/313 |

OTHER PUBLICATIONS

Brokaw, "A Simple Three–Terminal IC Bandgap Reference," IEEE Journal of Solid–State Circuits, vol. SC–9, No. 6, pp. 388–393 (1974).

Kuijk, "A Precision Reference Voltage Source," IEEE Journal of Solid–State Circuits, vol. SC–8, No. 3, pp. 222–226 (1973).

Widlar, "New Developments in IC Voltage Regulators," IEEE Journal of Solid–State Circuits, vol. SC–6, No. 1, pp. 2–7 (1971).

*Primary Examiner*—Peter S. Wong
*Assistant Examiner*—Shawn Riley
*Attorney, Agent, or Firm*—John Gustav Larson

[57] ABSTRACT

A voltage reference generator circuit (600) that operates at low voltages may be obtained by using a summation circuit (618) to combine a divided bipolar junction voltage signal (616) and a multiplied voltage signal (622) that is proportional to absolute temperature. The voltage reference generator circuit (600) generates a voltage reference which is divided by a divide circuit (620) which produces the divided signal (616), and a voltage reference which is multiplied by a multiply circuit (630) which produces the multiplied signal (622). In another form, a bipolar junction voltage and a voltage that is proportional to absolute temperature may be converted to currents and summed to provide a current which is converted into the reference voltage output.

20 Claims, 5 Drawing Sheets

-PRIOR ART-

-PRIOR ART-

-PRIOR ART-

-PRIOR ART-

900

LOW VOLTAGE REFERENCE CIRCUIT AND METHOD OF OPERATION

CROSS REFERENCE TO THE RELATED APPLICATION

Related subject matter may be found in copending U.S. application Ser. No. 08/518,768 filed Aug. 24, 1995 and assigned to the assignee hereof.

FIELD OF THE INVENTION

This invention relates generally to voltage references and more specifically to a low voltage bandgap voltage reference.

BACKGROUND OF THE INVENTION

Voltage references are commonly used in the electronics industry to provide known voltages to systems and circuits. The use of such references allows the design and manufacture of stable supply voltages and the monitoring and measuring of events. It is desirable for a voltage reference to be stable across temperature. A bandgap voltage reference generator is a known type of voltage reference generator, which is stable across temperature. The bandgap voltage reference generator operates by summing together a junction voltage Vj and a voltage that is proportional to absolute temperature (Vpat). FIG. 1 illustrates a known circuit 100 used to generate the voltage Vj 102. The circuit 100 has a current source 104 connected to a diode 106, such that the diode 106 is forward biased. The voltage Vj is the forward bias voltage of the diode 106. FIG. 2 illustrates graphically the known transfer characteristic curve of the voltage Vj 102 over temperature. The horizontal-axis of the graph represents absolute temperature in degrees Kelvin. The vertical-axis represents the voltage Vj 102. At room temperature, a junction formed with a typical process would have a junction voltage Vj 102 between 0.4 and 0.7 volts. At 0° K., the junction voltage would be limited by the bandgap voltage ($V_{BG}$). The bandgap voltage for silicon is a known, nearly constant value of approximately 1.2 volts. Between 0° K. and room temperature, 300° K., the transfer characteristic curve is represented by a nearly linear curve between the voltage value at 0° K. and the voltage value at 300° K. These voltage values are approximately 1.2 volts and 0.5 volts respectively. Therefore, the transfer characteristic curve has a negative slope.

FIG. 3 illustrates a known voltage proportional to temperature (VPT) generator circuit 300 used to generate the voltage Vpat. While a VPT generator can be generated in either MOS or bipolar technology, the illustrated VPT generator 300 depends on the exponential diffusion dominant nature of the sub-threshold current in an MOS device. As such, if the current densities in transistors 308 and 306 are sufficiently small so that the transistors operate in the sub-threshold region, also called the weak inversion region, a voltage proportional to absolute temperature will be present at node 312, providing the width of transistor 306 is greater than that of transistor 308, their lengths are substantially identical, and the gate electrode voltage applied to both transistors 306 and 308 is such that they both carry the same value of current. FIG. 4 illustrates a known transfer characteristic curve for the VPT generator 300. The vertical-axis represents the voltage proportional to absolute temperature (Vpat); the horizontal-axis represents the temperature in degrees Kelvin. As the temperature approaches absolute zero (0° K.), Vpat approaches zero volts. The transfer characteristic curve is represented by a line between a value of 20 to 80 millivolts at room temperature, depending on the ratio of the size of transistor 306 to the size of transistor 308 and the particular device process technology used for the transistors, and zero volts at absolute zero. The curve is linear and has a positive slope.

FIG. 5 illustrates a transfer characteristic curve for a Vj labeled 504 and an amplified transfer characteristic curve for a Vpat labeled 506. The transfer characteristic curve for Vj 202 (FIG. 2), and the transfer characteristic curve for Vpat (FIG. 4), have slopes in opposite directions. Amplifying the slope of Vpat (FIG. 4) provides a slope equal to but opposite that of the slope of Vj 505. This amplified slope is represented by the curve 506. Adding the Vj voltage curve 504 and the amplified voltage curve 506 provides a voltage reference curve (Vref) 502 that is independent of temperature variation. The slope of Vref curve 502 is essentially zero. The further use of voltage shifting techniques allows the voltage reference level to be shifted to values above or below 1.2 volts.

While the use of bandgap voltage reference generators is widespread, they have been limited to use with power supply voltages above the bandgap voltage of approximately 1.2 volts. Present applications requiring batteries and lower voltages have created a need for voltage references below the 1.2 volts reference value. Therefore, the need exists for a bandgap type voltage reference generator that can operate with and generate low voltages, and for a voltage reference generator that can generate multiple reference voltages.

DETAILED DESCRIPTION OF THE DRAWINGS

Generally, the present invention provides a method and apparatus for a low supply voltage reference voltage generator. Typically the use of voltage reference generators requires a supply voltage of greater than 1.2 volts. The present invention can operate with a power supply voltage at or below 0.9 volt, and generate low voltage references below 0.9 volt as well.

Figure 1:
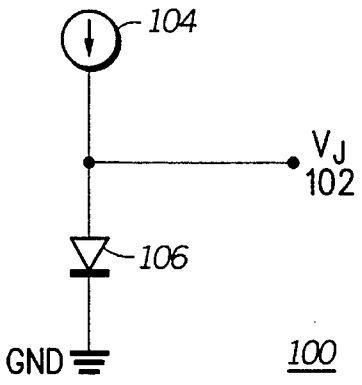
FIG. 1 illustrates, in schematic form, a prior art circuit for a junction voltage generator.
Figure 2:
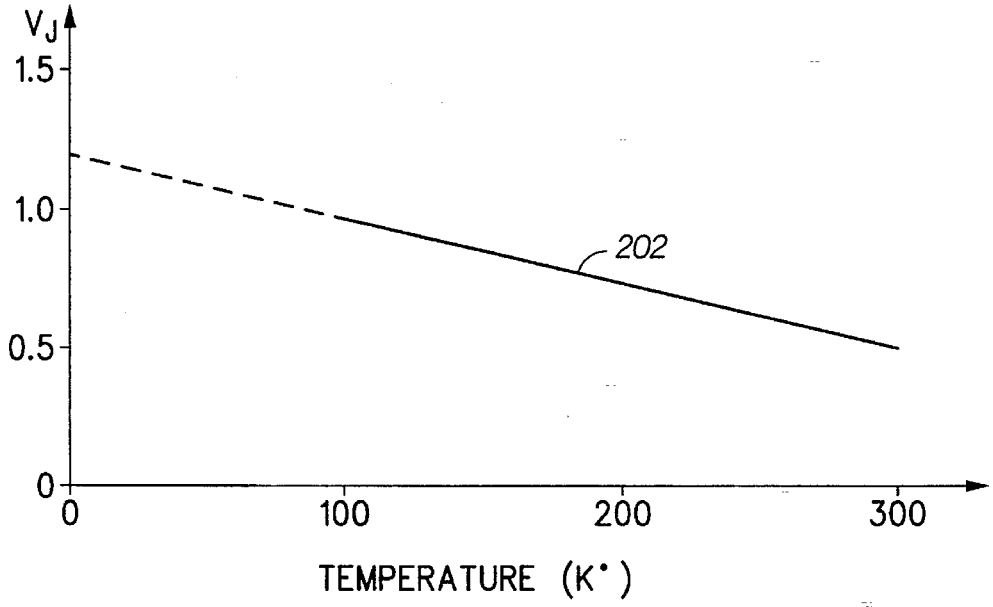
FIG. 2 illustrates, in graphical form, a prior art characteristic curve of the junction voltage versus temperature.
Figure 3:
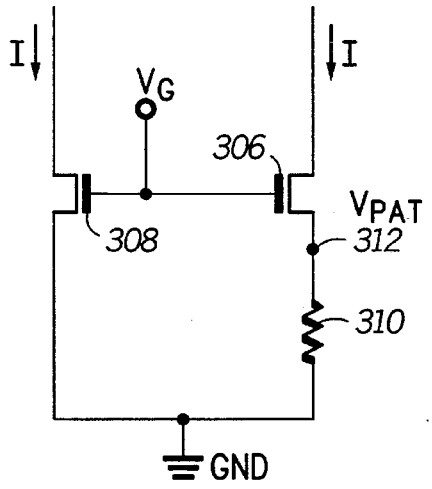
FIG. 3 illustrates, in schematic form, a prior art circuit for a voltage proportional to absolute temperature generator.
Figure 4:
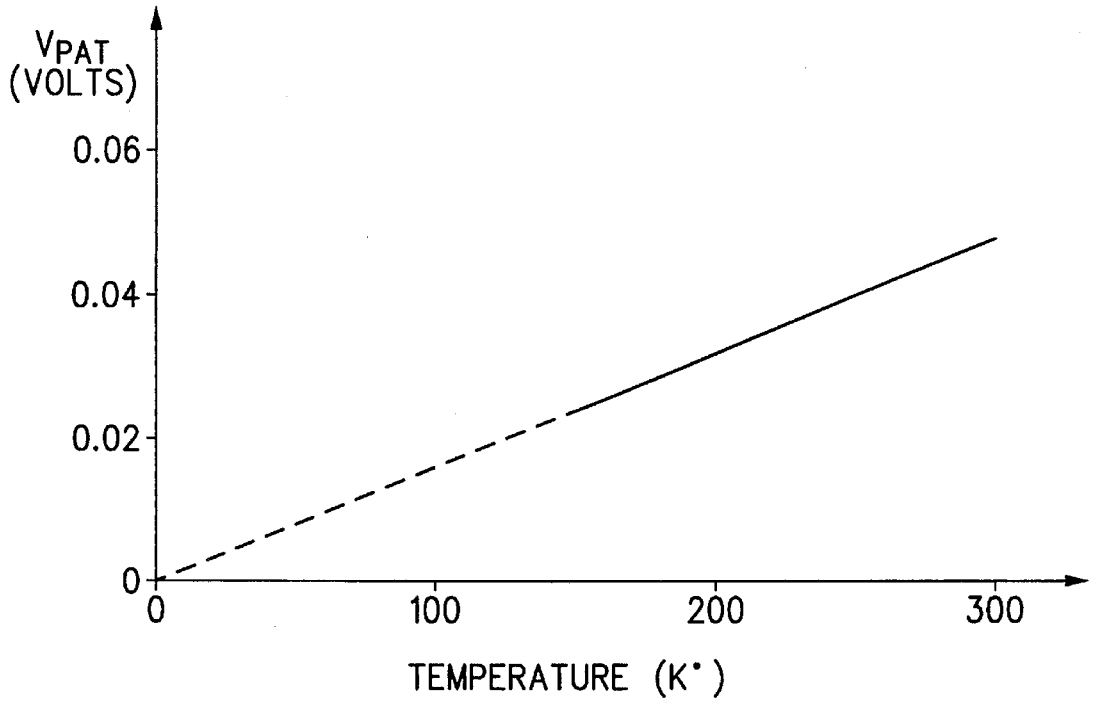
FIG. 4 illustrates, in graphical form, a prior art characteristic curve of a voltage proportional to absolute temperature versus absolute temperature.
Figure 6:
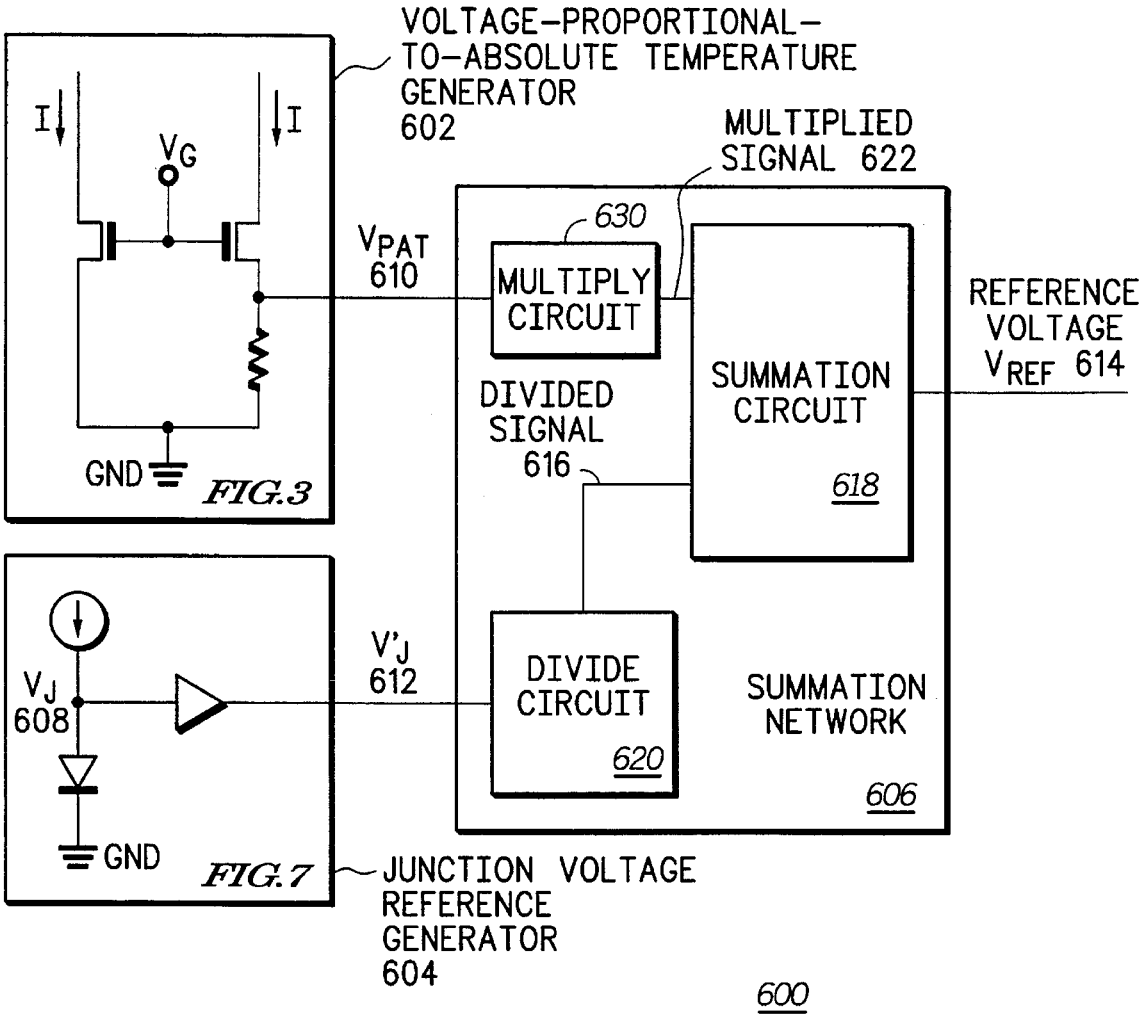
FIG. 6 illustrates, in block diagram form, a bandgap voltage generator in accordance with the present invention.

FIG. 6 illustrates a voltage generator circuit 600 in accordance with the present invention. The voltage generator circuit 600 includes a voltage-proportional-to-absolute temperature generator 602 (VPT generator), a voltage reference generator 604, and a summation network 606. The VPT generator 602 produces a voltage signal Vpat 610 which is a temperature dependent voltage reference. In this embodiment the signal Vpat 610 varies proportionally to absolute temperature, between 20 to 80 millivolts at room temperature, depending on the ratio of the size of transistor 306 to the size of transistor 308 and the particular device process technology used for the transistors, and 0.0 volts at absolute zero. The junction voltage reference generator 604 generates the signal Vj 608 which is a junction voltage reference. This signal is a representation of a bipolar junction voltage as illustrated in FIG. 2. The summation network 606 receives the signals Vpat 610 and a buffered junction voltage reference Vj' 612. Upon receiving these signals, the summation network 606 produces the reference voltage Vref 614.

Figure 7:
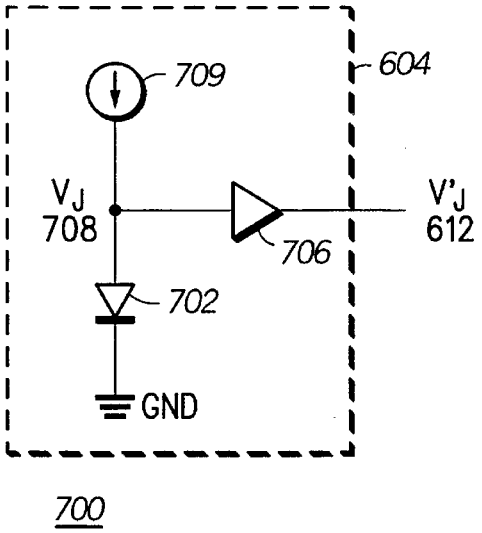
FIG. 7 illustrates, in partial schematic form, a junction voltage generator.

FIG. 7 illustrates a junction voltage reference generator 604 in accordance with the invention. The generator 604 comprises a current source 709, a diode 702 having a bipolar junction, and a buffer 706. The current source 709 is connected to the diode 702 such that diode 702 is forward biased creating a voltage reference Vj across the diode. The input to buffer 706 is connected to receive Vj 708, which is generated at the node common to current source 709 and diode 702. The buffer 706 can be implemented using a unity gain amplifier. The output of buffer 706 is signal Vj' 612 which is proportional to the diode voltage at the input of buffer 706. The buffer 706 is used to prevent loading at the output portion of the circuit from affecting the voltage Vj 708.

Figure 5:
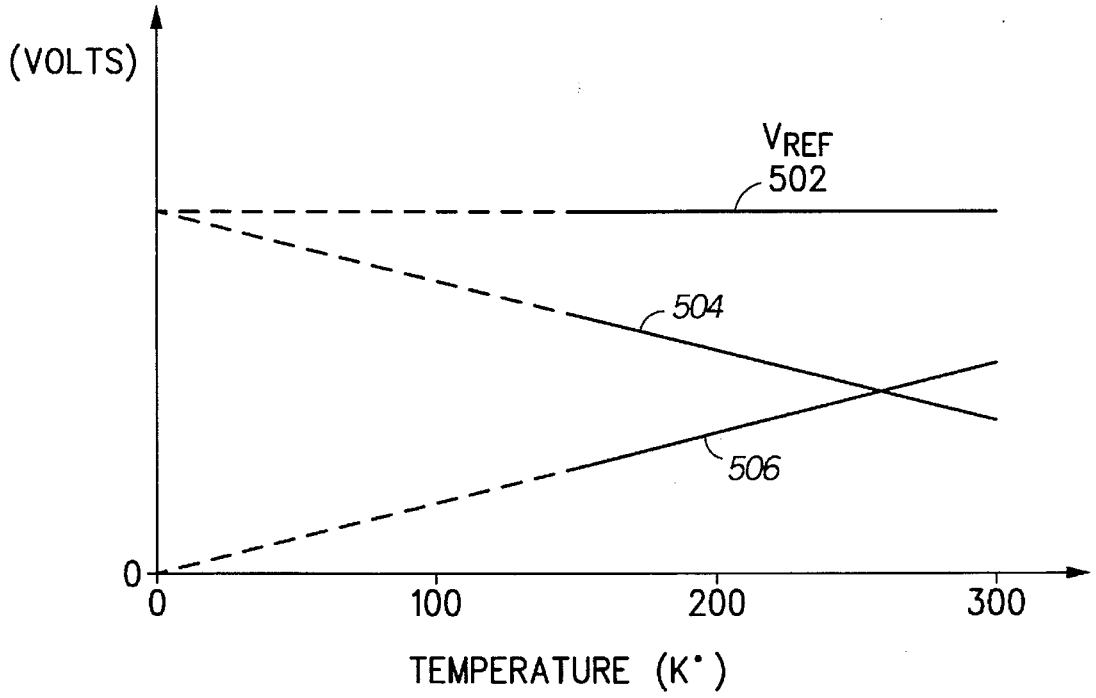
FIG. 5 illustrates, in graphical form, the summation of a junction voltage characteristic curve and the voltage proportional to absolute temperature characteristic curve.

As illustrated in FIG. 6, the summation network 606 comprises a divide circuit 620, a multiply circuit 630, and a summation circuit 618. The divide circuit 620 receives signal Vj' 612 and provides a divided signal 616 as its output. The voltage multiply circuit 630 receives signal Vpat 610 and provides a multiplied signal 622 as its output. The divided signal 616 and the multiplied signal 622 are received by the summation circuit 618. These two received signals are summed together by the summation circuit 618. The summation of these signals produces a reference voltage as its output. As illustrated in FIG. 5, the voltage Vref 502, which is analogous to reference voltage 614, is generated by summing together the Vj 504 and the amplified Vpat signal 506. The slopes of these representations are opposite such that their combination provides a temperature independent voltage as represented by signal Vref 502.

A prior art limitation occurs because of the bandgap voltage. The bandgap voltage of a silicon bipolar junction is approximately 1.2 volts. To generate a voltage reference of 1.2 volts, it would require a supply voltage of somewhat more than 1.2 volts. Therefore, the lowest operating voltage, in an ideal situation, would be greater than 1.2 volts. The addition of the divide circuit 620 as shown in FIG. 6 allows the slope of the Vj versus temperature transfer characteristic curve (FIG. 2) to be changed. By changing the slope of this curve, the point at which the transfer characteristic curve intercepts the vertical-axis is also modified. For example, if the voltage divide circuit 620 divided the Vj' input signal, represented by the transfer characteristic curve 504 of FIG. 5, by two, the new vertical-axis intercept would be at 0.6 volt. The vertical-intercept of 0.6 volt now represents the voltage reference that can be generated. This is accomplished by amplifying Vpat 610 so that its slope is approximately the inverse of the slope of the curve representative of Vj' 612. Now that the reference voltage is 0.6 volt, it is possible to operate at a supply voltage of 0.9 volt or less. The 0.9 volt is representative of a minimum supply voltage available in many battery operated applications.

Figure 8:
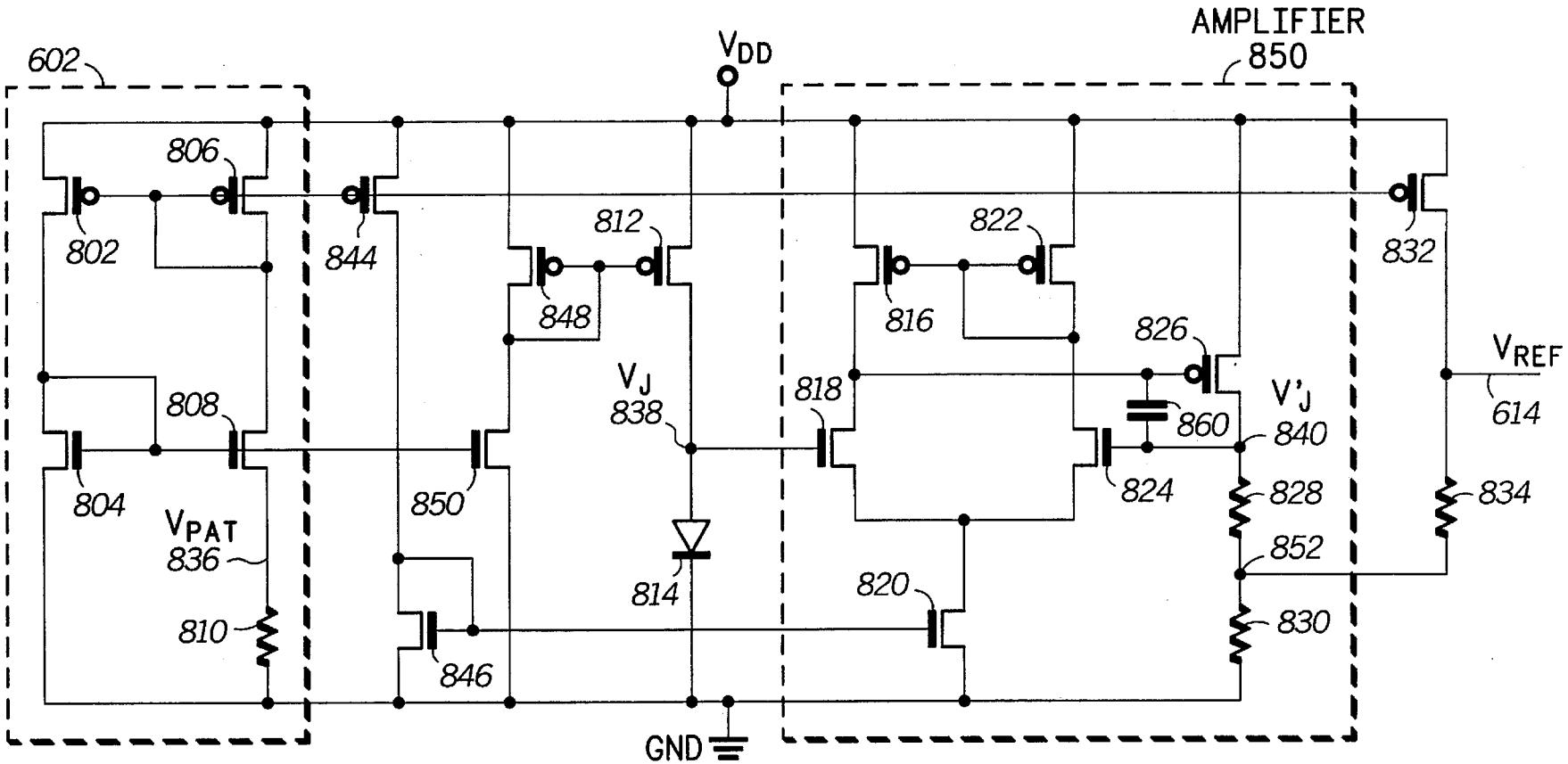
FIG. 8 illustrates, in schematic form, a voltage reference circuit in accordance with the present invention.

FIG. 8 illustrates a low voltage reference circuit 800 in accordance with the present invention. The voltage reference circuit 800 implements the VPT generator 602 with P-channel transistors 802, and 806, N-channel transistors 804, and 808, and resistor 810. This implementation of the voltage-proportional-to-absolute-temperature generator 602 is known prior art. Transistor 802 has a source electrode connected to a power supply $V_{DD}$, a drain electrode, and a gate electrode. Transistor 806 has a source electrode connected to power supply $V_{DD}$, a drain electrode, and a gate electrode connected to the drain electrode of transistor 806 and to the gate electrode of transistor 802. Transistor 804 has a drain electrode connected to the drain electrode of transistor 802, a source electrode connected to receive a ground signal, and a gate electrode connected to the drain electrode of transistor 804. Transistor 808 has a drain electrode connected to the drain electrode of transistor 806, a source electrode connected to a first terminal of a resistor 810, and a gate electrode connected to the gate electrode of transistor 804. The resistor 810 has a second terminal connected to the ground signal. The node common to the source electrode of transistor 808 and the first terminal of resistor 810 is node 836. The node 836 is analogous to the signal Vpat 610 of FIG. 6.

The current density in N-channel transistor 804 and N-channel transistor 808 of the VPT generator 602 is sufficiently low so that these transistors operate in the sub-threshold or weak inversion region, and in accordance with one embodiment of the invention, the transistor width ratio is such that the width of transistor 808 is four times that of transistor 804. In this implementation, if both transistors 804 and 808 carry the same current, the VPT generator 602 as shown in FIG. 8 will produce a voltage reference at node 836 of 35 to 50 millivolts depending on the characteristics of the particular silicon device technology used for the circuit. The node 836 is analogous to the signal Vpat 610 of FIG. 6. The amount of current passing through transistor 806 and transistor 808 is controlled by the resistor 810. For example, if a 1 microampere current is desired to operate at a temperature of 300° K. for a particular silicon device technology that produces a reference voltage of 40 millivolts, the resistor 810 would be chosen to be 40 kilo-ohms. This current is proportional to the voltage Vpat. Transistors 806 and 802 form a current mirror. If transistors 802 and 806 are substantially the same, the current in transistor 802 will be the same as the current in transistor 806, if the effects of output impedance and process variation are disregarded. Transistor 802 controls the current in transistor 804 thus assuring that transistors 804 and 808 carry the same current if the effects of output impedance and process variation are disregarded. In addition, the current can be replicated in other parts of the circuit by driving the gate electrode of an N-channel or a P-channel transistor with the gate electrode voltage of N-channel transistor 804 or P-channel transistor 806 respectively.

The junction voltage generator 604 (FIG. 6) is implemented as illustrated in FIG. 8 using a P-channel transistor 812, a diode 814, and an amplifier 850. N-channel transistor 850 and P-channel transistor 848 control the current in P-channel transistor 812. The amplifier 850 comprises P-channel transistors 816, 822, and 826, N-channel transistors 818, 824, and 820, and resistors 828 and 830. P-channel transistor 844 and N-channel transistor 846 set up the current bias for the amplifier.

Transistor 850 has a gate electrode connected to the gate electrode of transistor 804, a source electrode connected to receive the ground signal, and a drain electrode. Transistor 848 has a source electrode connected to power supply $V_{DD}$, a drain electrode connected to the drain electrode of transistor 850, and a gate electrode connected to the drain electrode of transistor 848. Transistor 812 has a gate electrode connected to the gate electrode of transistor 848, a source electrode connected to power supply $V_{DD}$, and a drain electrode. The diode 814 has an anode connected to the drain electrode of transistor 812, and a cathode connected to the ground signal. The node common to the diode 814 and transistor 812 is node 838, which represents the forward biased junction voltage of the diode Vj 608 of FIG. 6.

Transistor 816 has a source electrode connected to power supply $V_{DD}$, a gate electrode, and a drain electrode. Transistor 818 has a drain electrode connected to the drain electrode of transistor 816, a gate electrode connected to node 838, and a source electrode. Transistor 844 has a gate source electrode connected to power supply $V_{DD}$, a gate electrode connected to the gate electrode of transistor 806, and a drain electrode. Transistor 846 has a source electrode connected to the ground signal, a drain electrode connected to the drain electrode of transistor 844, and a gate electrode connected to the drain electrode of transistor 846. Transistor 820 has a drain electrode connected to the source electrode of transistor 818, a gate electrode connected to the gate electrode of transistor 846, and a source electrode connected to the ground signal. The transistor 822 has a source electrode connected to power supply $V_{DD}$, a gate electrode connected to the gate electrode of transistor 816, and a drain electrode connected to the gate electrode of transistor 822. The transistor 824 has a drain electrode connected to the drain electrode of transistor 822, a gate electrode, and a source electrode connected to the drain electrode of transistor 820. The transistor 826 has a source electrode connected to power supply $V_{DD}$, a gate electrode connected to the drain electrode of transistor 818 and the first terminal of capacitor 860, and a drain electrode connected to the gate electrode of transistor 824 and the second terminal of capacitor 860, and to a first terminal of a resistor 828. The resistor 828 has a second terminal connected to a first terminal of a resistor 830. The resistor 830 has a second terminal connected to the ground signal. Node 852 is the node common to the second terminal of resistor 828 and to the first terminal of resistor 830. Node 840 is the node common to the drain electrode of transistor 826, the gate electrode of transistor 824 and the first terminal of resistor 828. The node 840 is analogous to signal Vj' 612 of FIG. 6.

The N-channel transistor 850 acts as a current source and receives the same gate electrode voltage that drives the gate of transistor 804. Typically, transistor 850 has a much smaller width than transistor 804 and conducts a much smaller current. The P-channel transistors 848 and 812 acts as a current mirror. The current generated by P-channel transistor 812 passes through diode 814, creating a forward junction bias across diode 814. A junction voltage (Vj 608 of FIG. 6) is present at a node 838. The junction voltage is buffered through the amplifier 850. Vj is received by the amplifier 850 input that is the gate electrode of N-channel transistor 818. The output of the amplifier is at an output node 840. The voltage present at output node 840, Vj' 612 of FIG. 6, is substantially similar to the diode voltage present at node 838, Vj 608 of FIG. 6.

The summation network 606 (FIG. 6) is represented in FIG. 8 by P-channel transistors 806 and 832, N-channel transistor 808, and resistors 810, 834, 828, and 830. (P-channel transistor 806, N-channel transistor 808, and resistor 810 are also part of VPT generator 602. Resistors 828 and 830 are also part of amplifier 850.) The divide circuit 620 (FIG. 6) is represented by the series connection of resistor 828 and resistor 830. Resistor 828 is connected to node 840 which provides a signal analogous to signal Vj' 612 (FIG. 6). The multiply circuit 630 (FIG. 6) is represented by the transistors 806, 808, 832 and resistors 810, 828, 830 and 834. The summation circuit 618 (FIG. 6) is represented by resistors 828, 830, and 834.

Transistor 832 has a source electrode connected to the power supply $V_{DD}$, a gate electrode connected to the gate electrode of transistor 806, and a drain electrode connected to a first terminal of a resistor 834. The second terminal of the resistor 834 is connected to node 852. A node common to the drain electrode of transistor 832 and to the first terminal of resistor 834 is node 614 which represents the reference voltage Vref 614 (FIG. 6).

In the divide circuit, the voltage Vj' 612, which is represented at node 840 is coupled to a resistor divider network consisting of resistor 828 in series with resistor 830. Node 852 is the node common to the two resistors 828 and 830. Although resistors 828 and 830 act as a divide circuit, and node 852 is analogous to the node at which the divided signal 616 is present in FIG. 6, the signal present at node 852 is not equivalent to the divided signal 616 of FIG. 6 because the resistors 828 and 830 are also part of the summation circuit 618 of FIG. 6 which modifies the result of the resistor divider network. Resistors 828, 830, and 834 form a linear network with, what is effectively two sources, a voltage source, Vj', at node 840 and a current source, transistor 832. If the superposition principle is used, then from the point of view of the voltage source, Vj', the network looks like resistor 828 is in series with resistor 830 between the voltage source Vj' and the ground signal with resistor 834 connected at node 852 and being unconnected at its other terminal. From this point of view, node 852 is equivalent to node 616 of FIG. 6.

In the multiply circuit, resistor 810 connecting node 836, which represents signal Vpat 610 of FIG. 6, and the ground signal causes a current proportional to the voltage Vpat to flow through resistor 810 and transistors 808 and 806. Transistors 806 and 832 form a current mirror. If transistors 806 and 832 are substantially the same except for the width of the transistors then the current in transistor 832 will be a multiple of the current in transistor 806 with the multiplier being the ratio of the width of transistor 832 to the width of transistor 806 if the effects of output impedance and process variation are disregarded. The current from transistor 832 flows into resistor 834 and resistors 828 and 830. If the superposition principle is again used, then from the point of view of the current from transistor 832, the network looks like resistor 834 is in series with the parallel combination of resistor 828 and 830. The voltage generated across the resistor network of resistor 834 in series with the parallel combination of resistors 820 and 830 by the current from transistor 832 is a multiple of the voltage Vpat. From this superposition point of view, node 614 is equivalent to node 622 of FIG. 6. The multiply factor is the ratio of the width of transistor 832 to the width of transistor 806 multiplied by the ratio of resistor 810 to the combination of resistor 834 in series with the parallel combination of resistors and 830.

Resistors 828, 830, and 832 also act to sum the divided voltage from node 840 and the multiplied voltage from node 836 at node 614. The operation of the summation network components in FIG. 8, and specifically the generation of Vref, can be understood through the following equations: Summing the currents into node 852:

$$((V40-V52)/R28)-(V52/R30)+((Vref-V52)/R34)=0; \quad (1)$$

where:

V40 is the voltage at node 840;

V52 is the voltage at node 852;

R28 is the resistance of resistor 828;

R30 is the resistance of resistor 830;

Vref is the voltage represented by reference voltage 614;

R34 is the resistance of resistor 834.

Summing the currents into node 614:

$$((V52-Vref)/R34)+I32+0; \quad (2)$$

where

I32 is the current in transistor 832.

Solving eqns. (1) and (2) for Vref while eliminating V52:

$$Vref=(V40\cdot R30/(R28+R30))+(I32\cdot(R34+(R28\cdot R30/(R28+R30)))); \quad (3)$$

V40 is equal to Vj'. By assuring transistors 806 and 832 are identical, except for their width, and applying the voltage present on the gate electrode of transistor 806 to the gate electrode of transistor 832, the current passing through transistor 832 will be ratioed to the current passing through transistor 806 by the ratio of the width of transistor 832 to the width of transistor 806. The current in transistor 806 is equal to the current through resistor 810 of the VPT generator 602. It should be noted that the words "equal," "identical," and "ratio" are meant to disregard the effects of output impedance and process variations. The currents are substantially represented by the following equations:

$$I32=I06\cdot(W32/W06); \quad (4)$$

$$I06=I10=V36/R10; \quad (5)$$

where:

I10 is the value of the current through resistor 810;

V36 is the voltage at node 836;

R10 is the resistance of resistor 810;

W32 is the width of transistor 832;

W06 is the width of transistor 806.

Substituting eqn. (4) and (5) into eqn. (3):

$$Vref=(V40\cdot R30/(R28+R30))+(V36\cdot(W34/W06)\cdot(R34+(R28\cdot R30/(R28+R30)))/R10); \quad (6);$$

V40, Vj' 612 of FIG. 6, is substantially equal to the voltage at node 838, Vj 608 of FIG. 6, and V36 is equivalent to Vpat 610 of FIG. 6 so eqn.(6) can be rewritten as:

$$Vref=(Vj\cdot R30/(R28+R30))+(Vpat\cdot(W34/W06)\cdot(R34+(R28\cdot R30/(R28+R30)))/R10); \quad (7);$$

Note that Vj is multiplied by the ratio of R30 to the sum of R28 plus R30, the ratio being less than one, that Vpat is multiplied by the ratio of W34 to W06 and by the ratio of R34 in series with the parallel combination of R28 and R30 to R10, and that the divided Vj and the multiplied Vpat are added. Note also that resistors 828 and 830 form a first ratio, resistors 834 and 810 form a second ratio, resistors 828 and 810 form a third ratio, and transistor widths W34 and W06 form a fourth ratio. These ratios can be represented by:

$$R30/(R28+R30)=Rr1; \quad (8)$$

$$R34/R10=Rr2; \quad (9)$$

$$R28/R10=Rr3; \quad (10)$$

$$W34/W06=Rw4; \quad (11)$$

Substituting eqn. (8), (9), (10), and (11) into eqn. (7):

$$Vref=(Vj\cdot Rr1)+(Vpat\cdot Rw4\cdot(Rr2+(Rr3\cdot Rr1))); \quad (12)$$

Note that all the resistors form ratios so that any correlated process or temperature variation in the resistance values will cancel.

In accordance with the invention, appropriate selection of the values of R10, Rr1, Rr2, Rr3, and Rw4 can provide a value of Vref below 0.9 volt and allow circuit operation at or below 0.9 volt.

Figure 9:
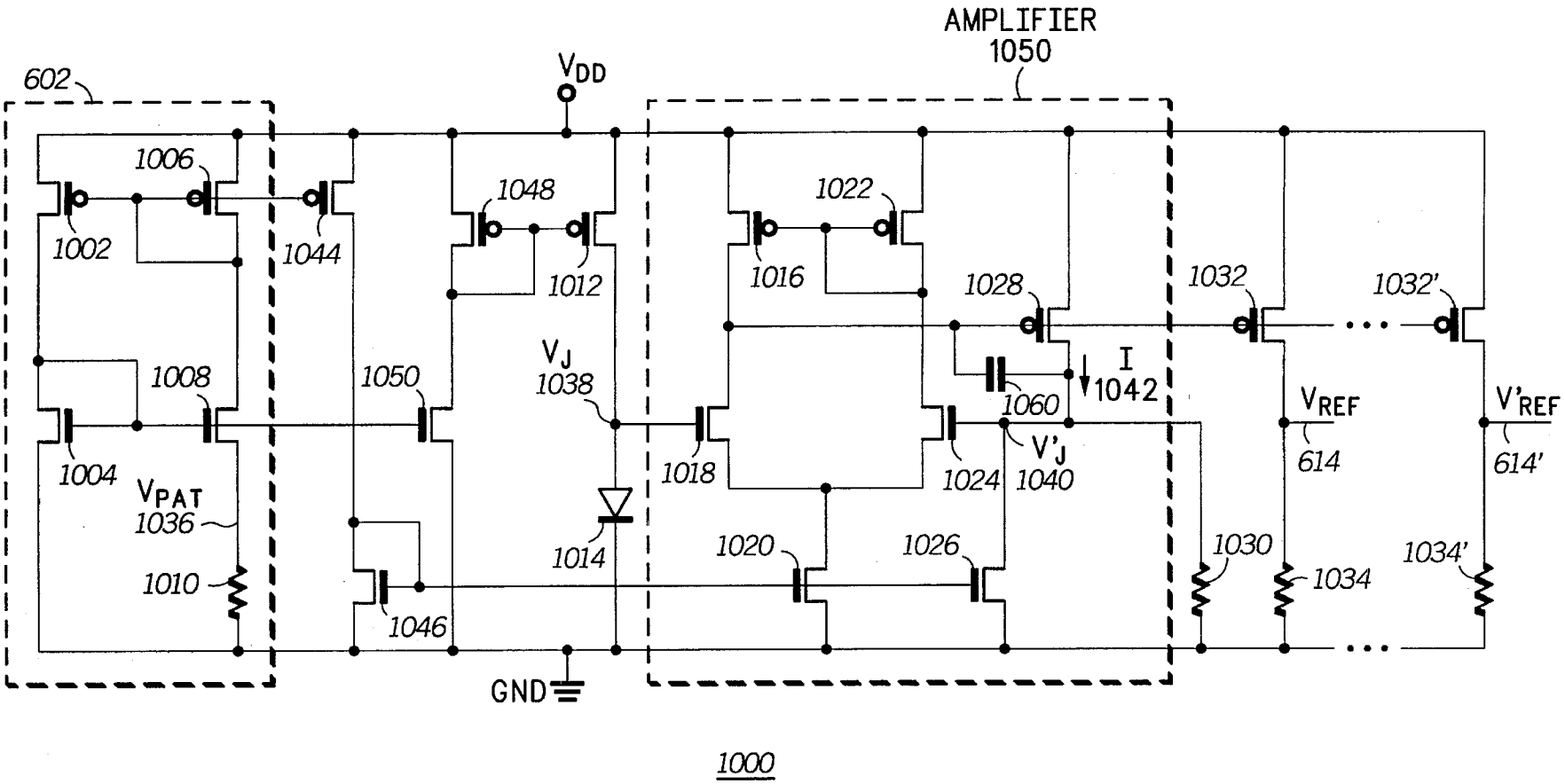
FIG. 9 illustrates, in schematic form, a voltage reference circuit in accordance with the present invention.

FIG. 9 illustrates another circuit embodiment in accordance with the present invention. The voltage reference circuit 1000 implements the VPT generator 602 with P-channel transistors 1002, and 1006, N-channel transistors 1004, and 1008, and resistor 1010. Transistor 1002 has a source electrode connected to a power supply $V_{DD}$, a drain electrode, and a gate electrode connected to the gate electrode of transistor 1002. Transistor 1006 having a source electrode connected to a power supply $V_{DD}$, a drain electrode, and a gate electrode connected to the drain electrode of transistor 1006 and to the gate electrode of transistor 1002. Transistor 1004 has a drain electrode connected to the drain electrode of transistor 1002, a source electrode connected to receive a ground signal, and a gate electrode connected to the drain electrode of transistor 1004. Transistor 1008 has a drain electrode connected to the drain electrode of transistor 1006, a source electrode coupled to a first terminal of a resistor 1010, and a gate electrode coupled to the gate electrode of transistor 1004. The resistor 1010 has a second terminal connected to receive the ground signal. The node common to the source electrode of transistor 1008 and the first terminal of resistor 1010 is node 1036. The node 1036 is analogous to the signal Vpat 610 of FIG. 6.

The current density in N-channel transistor 1004 and N-channel transistor 1008, of the VPT generator 602, is sufficiently small so that these transistors operate in the sub-threshold or weak inversion region, and in accordance with one embodiment of the invention, the transistor width ratio is such that the width of transistor 1008 is four times that of transistor 1004. In this implementation, if both transistors 1004 and 1008 carry the same current, the VPT generator 1002 as shown in FIG. 9 will produce a voltage reference at node 1036 of 35 to 50 millivolts depending on the characteristics of the particular silicon device technology used for the circuit. The amount of current passing through transistor 1006 and transistor 1008 is controlled by the resistor 1010. For example, if a 1 microampere current is desired, at a temperature of 300° K. for a particular silicon device technology that produces a reference voltage of 40 millivolts, the resistor 1010 would be chosen to be 40 kilo-ohms. This current is proportional to the voltage Vpat. Transistor 1006 and 1002 form a current mirror. If transistors 1002 and 1006 are substantially the same then the current in transistor 1002 will be the same as the current in transistor 1006 if the effects of output impedance and process variation are disregarded. Transistor 1002 controls the current in transistor 1004 thus assuring that transistors 1004 and 1008 carry the same current if the effects of output impedance and process variation are disregarded. In addition, the current can be replicated in other parts of the circuit by driving an N-channel or a P-channel transistor with the gate electrode voltage of N-channel transistor 1008 or P-channel transistor 1006.

The junction voltage generator 604 (FIG. 6) is implemented as illustrated in FIG. 9 using a P-channel transistor 1012, a diode 1014, and an amplifier 1050. N-channel transistor 1050 and P-channel transistor 1048 control the current in P-channel transistor 812. The amplifier 1050 comprises P-channel transistors 1016, 1022, and 1026, and N-channel transistors 1018, 1024, 1020, and 1026. P-channel transistor 1044 and N-channel transistor 1046 set up the current bias for the amplifier.

Transistor 1050 has a gate electrode connected to the gate electrode of transistor 1004, a source electrode connected to receive the ground signal, and a drain electrode. Transistor 1048 has a source electrode connected to power supply $V_{DD}$, a drain electrode connected to the drain electrode of transistor 1050, and a gate electrode connected to the drain electrode of transistor 1048. Transistor 1012 has a gate electrode connected to the gate electrode of transistor 1048, a source electrode connected to power supply $V_{DD}$, and a drain electrode. The diode 1014 has an anode connected to the drain electrode of transistor 1012, and a cathode connected to receive the ground signal. The node common to the diode 1014 and the transistor 1012 is node 1038 which represents the forward biased junction voltage of the diode, Vj 608 of FIG. 6.

Transistor 1016 has a source electrode connected to power supply $V_{DD}$, a gate electrode, and a drain electrode. Transistor 1018 has a drain electrode connected to the drain electrode of transistor 1016, a gate electrode connected to node 1038, and a source electrode. Transistor 1044 has a source electrode connected to power supply $V_{DD}$, a gate electrode connected to the gate electrode of transistor 1006, and a drain electrode. Transistor 1046 has a source electrode connected to receive the ground signal, a drain electrode connected to the drain electrode of transistor 1044, and a gate electrode connected to the drain electrode of transistor 1046. Transistor 1020 has a drain electrode connected to the source electrode of transistor 1018, a gate electrode connected to the gate electrode of transistor 1046, and a source electrode connected to receive the ground signal. The transistor 1022 has a source electrode connected to power supply $V_{DD}$, a gate electrode connected to the gate electrode of transistor 1016, and a drain electrode connected to the gate electrode of transistor 1022. The transistor 1024 has a drain electrode connected to the drain electrode of transistor 1022, a gate electrode, and a source electrode connected to the drain electrode of transistor 1020. The transistor 1028 has a source electrode connected to power supply $V_{DD}$, a gate electrode connected to the drain electrode of transistor 1018 and the first terminal of capacitor 1060, and a drain electrode connected to the gate electrode of transistor 1024 and the second terminal of capacitor 1060. Transistor 1026 has a source electrode connected to receive the ground signal, a gate electrode connected to the gate electrode of transistor 1046, and a drain electrode connected to the drain electrode of transistor 1028. Node 1040 is common to the drain electrode of transistor 1028, the gate electrode of transistor 1024, and the drain electrode of transistor 1026, and is the amplifier output node. The node 1040 is analogous to signal Vj' 612 of FIG. 6.

The N-channel transistor 1050 acts as a current source and receives the same gate electrode voltage that drives the gate of transistor 1004. Typically, transistor 1050 has a much smaller width than transistor 1004 and conducts a much smaller current. The P-channel transistors 1048 and 1012 act as a current mirror. The current generated by P-channel transistor 1012 passes through diode 1014, creating a forward junction bias across diode 1014. The junction voltage (Vj 608 of FIG. 6) is present at a node 1038. The junction voltage is buffered through the amplifier 1050. Vj is received by the amplifier 1050 input that is the gate electrode of N-channel transistor 1018. The output of the amplifier is at an output node 1040. The voltage present at output node 1040, Vj' 612 of FIG. 6, is substantially similar to the diode voltage present at node 1038, Vj 608 of FIG. 6.

The summation network 606 (FIG. 6) is represented in FIG. 9 by the generation of a current proportional to Vpat in the voltage-proportional-to-absolute-temperature generator 602 by resistor 1010, P-channel transistors 1044, 1028 and 1032, N-channel transistors 1046 and 1026, and resistors 1030, and 1034. (P-channel transistor 1028 and N-channel transistor 1026 are also part of amplifier 1050.) Resistor 1030 has a first terminal connected to the amplifier output node 1040 and a second terminal connected to receive the ground signal. Transistor 1032 has a source electrode connected to power supply $V_{DD}$, a gate electrode connected to the gate electrode of transistor 1028, and a drain electrode connected to the first terminal of a resistor 1034. Resistor 1034 has a second terminal connected to receive the ground signal. The node common to the drain electrode of transistor 1032 and the first terminal of resistor 1034 is Vref 614 of FIG. 6.

The multiply circuit, the divide circuit and the summation circuit are intertwined in this embodiment of the present invention. Currents proportional to Vpat and Vj' are first generated by resistors 1010 and 1030 respectively. The current proportional to Vpat generated by resistor 1010 is mirrored by transistors 1006 and 1044, mirrored and multiplied by transistors 1046 and 1026 and then added to the current proportional to Vj' generated by resistor 1030 at node 1040. Finally, after being mirrored and multiplied by transistors 1028 and 1032, the current is fed through resistor 1034 to generate the reference voltage, Vref.

The multiply circuit 630 (FIG. 6) is implemented in FIG. 9 by the generation of a current proportional to Vpat by resistor 1010 in the voltage-proportional-to-absolute-temperature generator 602, the mirroring of that current in transistors 1006 and 1044, the mirroring and multiplying of the current in transistors 1046 and 1026, the mirroring and multiplying of the current again in transistors 1028 and 1032, and the feeding of the mirrored current into resistor 1034. The divide circuit 620 (FIG. 6) is implemented by the generation of a current proportional to Vj by resistor 1030, the mirroring and multiplying of the current in transistors 1028 and 1032, and the feeding of the mirrored current into resistor 1034. Even though the current is multiplied by the transistors 1028 and 1032, the ratio of resistor 1034 to resistor 1030 has a net dividing effect on the voltage. The summation circuit is completed by connecting transistor 1026 and resistor 1030 at a common node 1040. The current present at this node, I 1042, ultimately controls the output voltage Vref. The following equations describe the relationship of the circuit components critical to the generation of the output reference voltage:

$$Vref=R34\cdot I32 \tag{13}$$

$$I32=(W32/W28)\cdot I28 \tag{14}$$

$$I28=I42 \tag{15}$$

$$I42=V40/R30+I26; \tag{16}$$

$$V40=Vj'=V38=Vj; \tag{17}$$

$$I26=(W26/W46)\cdot I46; \tag{18}$$

$$I46=I44; \tag{19}$$

$$I44=I06; \tag{20}$$

$$I06=I10; \tag{21}$$

$$I10=V36/R10; \quad (22)$$

$$V36=Vpat; \quad (23)$$

where:

Vref is the reference voltage and is the voltage present at node 614;

R34 is the value of the resistance of resistor 1032;

I32 is the value of the current passing through transistor 1032;

W32 is the value of the width of transistor 1032;

W28 is the value of the width of transistor 1028;

I28 is the value of the current passing through transistor 1028;

Transistors 1032 and 1028 are identical, within process variation limits, except for their widths which may be different; the current passing through transistor 1032 is equal to the current passing through transistor 1028 multiplied by the ratio of the width of transistor 1032 to the width of transistor 1028 within output impedance and processing variation limits;

I42 is analogous to the current represented by I 1042;

V40 is the value of the voltage present on node 1040;

Vj' is the value of the voltage present on node 1040, and is equal, within process limits, to the forward bias junction voltage Vj present at node 1038;

V38 is the value of the voltage present at node 1038;

Vj is the value of the junction voltage and is the voltage present at node 1038;

R30 is the value of the resistance of resistor 1030;

I26 is the value of the current passing through transistor 1026;

W26 is the gate width of transistor 1026;

W46 is the gate width of transistor 1046;

I46 is the value of the current passing through transistor 1046;

Transistors 1026 and 1046 are identical, within process variation limits, except for their widths which may be different and the current passing through transistor 1026 is equal to the current passing through transistor 1046 multiplied by the ratio of the width of transistor 1026 to the width of transistor 1046 within output impedance and processing variation limits;

I44 is the value of the current passing through transistor 1044;

I06 is the value of the current passing through transistor 1006;

Transistors 1044 and 1006 are identical, within process variation limits; the current passing through transistor 1044 is equal to the current in transistor 1006 with output impedance and process variation limits;

I10 is the value of the current passing through resistor 1010;

V36 is the value of the voltage present at node 1036;

R10 is the value of the resistance of resistor

Vpat is the value of the voltage proportional to absolute temperature and is the voltage present at node 1036.

Substituting eqns. (14) and (15) into eqn. (13):

$$Vref=R34\cdot(W32/W28)\cdot I42; \quad (24)$$

Substituting eqns. (17), (18), (19), (20), (21), (22), and (23) into eqn. (16):

$$I42=(Vj/R30)+((W26/W46)\cdot(Vpat/R10)); \quad (25)$$

Note that 142 is divided into two current components. One component is dependent on the voltage Vj and resistor R30. The other component is dependent on Vpat, resistor R10, and the ratio of W26 to W46.

Substituting eqn. (25) into eqn. (24):

$$Vref=(Vj\cdot(R34/R30)\cdot(W32/W28))+(Vpat\cdot(R34/R10)\cdot(W26/W46)\cdot(W32/W28)); \quad (26)$$

Note that Vj is multiplied by the ratio of R34 to R30 and W32 to W28 which has a net value of less than one, that Vpat is multiplied by the ratio of R34 to R10, W26 to W46, and W32 to W28 which has a net value of greater than one, and that the divided Vj and multiplied Vpat are summed.

Note that resistors R34 and R30 form a first ratio, that resistors R34 and R10 form a second ratio, that transistor widths W26 and W46, form a third ratio, and that transistor width W32 and W28 form a fourth ratio. The ratios can be described by:

$$R34/R30=Rr1; \quad (27)$$

$$R34/R10=Rr2; \quad (28)$$

$$W26/W46=Rw3; \quad (29)$$

$$W32/W28=Rw4. \quad (30)$$

Substituting eqn. (27), (28), (29), and (30) into eqn. (26):

$$Vref=(Rr1\cdot Rw4\cdot Vj)+(Rr2\cdot Rw3\cdot Rw4\cdot Vpat); \quad (31)$$

In accordance with the invention, appropriate selection of the values of R10, Rr1, Rr2, Rw3, and Rw4 can provide a value of Vref below 0.9 volt and allow circuit operation at or below 0.9 volt.

The circuit of FIG. 9 also allows multiple reference voltages to be obtained by duplicating the structure and connections of transistor 1032 and resistor 1034. For each stage cascaded in a manner such as this, a different voltage reference can be obtained. The current mirror configuration allows similar or different resistors or transistor widths to be selected in order to obtain desired voltage references.

FIG. 9 further illustrates the use of additional output stages to provide additional reference voltages. As shown, a P-channel transistor 1032', and a resistor 1034', can be connected in a manner similar to transistor 1032 and resistor 1034, with the gate electrode of transistor 1032' being connected to the gate electrode of transistor 1028. If transistors 1032 and 1032' are identical, then a different reference voltage may be obtained by varying the resistance value of resistor 1034'. If transistors 1032 and 1032' are identical except for the ratio of their widths, then both the transistor width ratio and the resistance value of resistor 1034' can be used to obtain the desired reference voltage. Theoretically, any number of additional output stages can be added.

The above discussion should make it apparent that there has been provided an improved low voltage reference circuit. Further, it should be apparent that there are numerous modifications which can be made to the disclosed circuit. For example, the circuit could be manufactured in MOS, Bipolar, BiCMOS, or other technologies. The conductivity type of the illustrated transistors may be reversed. There are numerous implementations of the junction voltage reference generator 604 that may be used, as well as other implementations of the voltage proportional to temperature generator 602. While the embodiment disclosed may specify specific transistor ratios or sizes, it is recognized that other transistor ratios and sizes could be used to meet the objectives of the invention. If desired, the invention could also be used to obtain an output voltage that varies over temperature by a known amount.

I claim:

1. A voltage reference circuit comprising:

a voltage-proportional-to-absolute temperature generator for producing a reference voltage which varies in magnitude proportional to temperature;

a forward biased bipolar junction voltage reference circuit for producing a junction voltage reference; and a summation network coupled to the voltage generator and the forward biased bipolar junction voltage reference circuit, for producing an output voltage reference which is less in magnitude than a bandgap voltage of a bipolar semiconductor junction, by changing the reference voltage by a first predetermined amount to provide an amplified reference voltage and changing the junction voltage reference by a second predetermined amount to provide a modified junction voltage reference prior to combining the modified reference voltage and the modified junction voltage reference to produce the output voltage reference.

2. The voltage reference circuit of claim 1, wherein the forward biased bipolar junction voltage reference circuit further comprises:

a diode for providing a forward biased junction voltage; and a buffer operably coupled to the diode, for providing the junction voltage reference.

3. The voltage reference circuit of claim 1, wherein the forward biased bipolar junction voltage reference circuit further comprises:

a transistor for providing a forward biased junction voltage; and a buffer, operably coupled to the transistor, for providing the junction voltage reference.

4. The voltage reference circuit of claim 2, wherein the summation network further comprises:

a divider circuit coupled to the buffer, for dividing the junction voltage reference to provide a divided reference;

a multiplier circuit coupled to the voltage generator, for multiplying the reference voltage to provide a multiplied reference; and a summation circuit coupled to the divider circuit and the multiplier circuit, for summing the divided reference and the multiplied reference to produce the voltage reference.

5. The voltage reference circuit of claim 3, wherein the summation network further comprises:

a divider circuit coupled to the buffer, for dividing the junction voltage reference to provide a divided reference;

a multiplier circuit coupled to the voltage generator, for multiplying the reference voltage to provide a multiplied reference; and a summation circuit coupled to the divider circuit and the multiplier circuit, for summing the divided reference and the multiplied reference to produce the voltage reference.

6. The voltage reference circuit of claim 1, wherein the summation network further comprises:

a sensing section coupled to the voltage generator and the forward biased bipolar junction voltage reference circuit for producing a first current based on the reference voltage, and a second current based on the junction voltage reference;

a current adder coupled to the sensing section for summing the first current and the second current to produce a total current; and an output section coupled to the current adder for producing the voltage reference based on the total current.

7. The voltage reference circuit of claim 6, wherein the summation network further comprises a plurality of output sections coupled to the current adder, wherein each of the plurality of output sections produces a separate voltage reference based on the total current.

8. A voltage reference circuit comprising:

a voltage generator that produces a reference voltage which varies in magnitude proportional to temperature;

a forward biased bipolar junction voltage reference circuit that produces a junction voltage reference;

a voltage multiply circuit coupled to the voltage generator, for receiving the temperature voltage reference, wherein the voltage multiply circuit multiplies the reference voltage by a multiplier to produce a multiplied voltage reference; and a voltage divider circuit coupled to the forward biased bipolar junction voltage reference circuit, for receiving the junction voltage reference, wherein the voltage divider circuit divides the junction voltage reference by a divisor to produce a divided junction voltage reference;

a summation circuit coupled to the voltage multiply circuit and the voltage divider circuit, wherein the summation circuit adds the multiplied voltage reference to the divided junction voltage reference to produce an output voltage reference.

9. A reference voltage circuit comprising:

a voltage generator that produces a reference voltage which varies in magnitude proportional to temperature;

a first voltage-to-current generator circuit coupled to the voltage generator for producing a current proportional to the temperature dependent voltage;

a forward biased bipolar junction voltage reference circuit for producing a junction voltage reference;

a second voltage-to-current generator circuit coupled to the forward biased bipolar junction voltage reference circuit for producing a current-proportional-to-junction-voltage reference;

a summation circuit coupled for receiving the current-proportional-to-the-temperature-dependent-voltage reference and the current-proportional-to-junction-voltage reference, wherein the summation circuit adds the current-proportional-to-the-temperature-dependent-voltage reference and the current-proportional-to-junction-voltage reference to produce a summed current; and an output stage coupled to the summation circuit for producing a voltage based on the summed current, where the voltage is substantially constant over temperature and below the bandgap voltage.

10. The reference voltage circuit of claim 9 further comprising a plurality of output stages coupled to the summation circuit for producing a plurality of voltages based on the summed current.

11. A reference voltage circuit comprising:

a temperature dependent voltage generator having a control terminal;

an amplifier circuit having a first input terminal, a second input terminal, and an output terminal coupled to the second input terminal thereof;

a current source having a sourcing terminal for providing a bias current;

a device having a bipolar junction, a first terminal coupled to the sourcing terminal such that the bipolar junction is forward biased, a second terminal coupled to a first voltage terminal, and a third terminal coupled to the first terminal of the device to provide an output voltage, to the first input terminal of the amplifier;

a summation circuit comprising:

a first transistor, of a first conductivity type, having a first current electrode coupled to a second voltage terminal, a second current electrode, and a control electrode coupled to the control terminal;

a first resistive element having a first terminal coupled to the second current electrode of the first transistor, and a second terminal;

a second resistive element having a first terminal coupled to the output terminal of the amplifier circuit, and a second terminal coupled to the second terminal of the first resistive element;

a third resistive element having a first terminal coupled to the second terminal of the second resistive element, and a second terminal coupled to the first voltage terminal; and an output terminal coupled to the first terminal of the first resistive element for providing an output voltage.

12. A voltage reference circuit comprising:

a temperature dependent voltage generator having a control terminal;

an amplifier circuit having a first input terminal, a second input terminal, and an output terminal;

a current source having a sourcing terminal for providing a bias current;

a device having a bipolar junction, a first terminal coupled to the sourcing terminal of the current source such that the bipolar junction is forward biased and, a second terminal coupled to a first voltage terminal; and a third terminal coupled to the first terminal of the device to provide an output voltage and to the first input terminal of the amplifier;

a summation circuit comprising:

a first transistor having a first conductivity type, a first current electrode coupled to a second voltage terminal, a second current electrode coupled to the second input terminal of the amplifier, and a control electrode coupled to the amplifier output terminal;

a second transistor, of a second conductivity type, having a first current electrode coupled to the second current electrode of the first transistor, a second current electrode coupled to the first voltage terminal, and a control electrode coupled to the control terminal of the temperature dependent voltage generator;

a first resistive element having a first terminal coupled to the second current electrode of the first transistor, and a second terminal coupled to the first voltage terminal;

a third transistor of the first conductivity type having a first current electrode coupled to the second voltage terminal, a second current electrode, and a control electrode coupled to the output terminal of the amplifier;

a second resistive element having a first terminal coupled to the second current electrode of the third transistor, and a second terminal coupled to the first voltage terminal;

an output terminal coupled to the first terminal of the second resistive element for providing an output voltage.

13. A method for providing a voltage reference which is substantially constant over a temperature range, the method comprising the steps of:

providing a voltage which is proportional-to-temperature across a resistive element, the voltage which is proportional-to-temperature which is provided across the resistive element resulting in a first current though a first conductive path;

applying a second current substantially proportional to the first current through a second conductive path;

generating a junction voltage across a bipolar junction device;

applying the junction voltage across a resistive element to generate a third current through a third conductive path, the second and third conductive paths being coupled to a common node, wherein a fourth conductive path is coupled to the common node and conducts a fourth current equal to a sum of the second current and the third current; and applying a current substantially proportional to the fourth current to a resistive load element for providing the reference voltage which is substantially constant over the temperature.

14. A reference voltage circuit comprising:

a first voltage reference circuit having a first voltage versus temperature transfer characteristic curve with a positive slope;

a second voltage reference circuit having a second voltage versus temperature transfer characteristic curve with a negative slope;

a first slope modification circuit coupled to the first voltage reference circuit, the first slope modification circuit modifying the positive slope of the first voltage versus temperature transfer characteristic curve to provide a modified first voltage versus temperature transfer characteristic curve;

a second slope modification circuit coupled to the second voltage reference circuit, the second slope modification circuit modifying the negative slope of the second voltage versus temperature transfer characteristic curve to produce a modified second voltage versus temperature transfer characteristic curve having a substantially equal but opposite value from the slope of the modified first voltage versus temperature transfer characteristic curve; and a summation circuit having a third transfer characteristic curve which is substantially equal to the summation of the modified first voltage versus temperature transfer characteristic curve and the modified second voltage versus temperature transfer characteristic curve, wherein a slope of the third transfer characteristic curve is substantially zero, and a voltage reference value represented by the third transfer characteristic curve is less than the bandgap voltage.

15. A voltage reference circuit comprising:

a voltage generator for producing a reference voltage which varies in magnitude proportional to temperature;

a forward biased bipolar junction voltage reference circuit for producing a junction voltage reference, wherein the bipolar junction voltage reference circuit comprises:

a diode for providing a forward biased junction voltage; and a buffer operably coupled to the diode, for providing the junction voltage reference; and a summation network coupled to the voltage generator and the forward biased bipolar junction voltage reference circuit, for producing an output voltage reference which is less in magnitude than a bandgap voltage of a bipolar semiconductor junction, by changing the reference voltage by a first predetermined amount to provide an amplified reference voltage and changing the junction voltage reference by a second predetermined amount to provide a modified junction voltage reference prior to containing the modified reference voltage and the modified junction voltage reference to produce the output voltage reference.

16. The voltage reference circuit of claim 15, wherein the summation network further comprises:

a divider circuit coupled to the buffer, for dividing the junction voltage reference to provide a divided reference;

a multiplier circuit coupled to the voltage generator, for multiplying the reference voltage to provide a multiplied reference; and a summation circuit coupled to the divider circuit and the multiplier circuit, for summing the divided reference and the multiplied reference to produce the voltage reference.

17. A voltage reference circuit comprising:

a voltage generator for producing a reference voltage which varies in magnitude proportional to temperature;

a forward biased bipolar junction voltage reference circuit for producing a junction voltage reference, wherein the bipolar junction voltage reference circuit comprises:

a transistor for providing a forward biased junction voltage; and a buffer, operably coupled to the transistor, for providing the junction voltage reference; and a summation network coupled to the voltage generator and the forward biased bipolar junction voltage reference circuit, for producing an output voltage reference which is less in magnitude than a bandgap voltage of a bipolar semiconductor junction, by changing the reference voltage by a first predetermined amount to provide an amplified reference voltage and changing the junction voltage reference by a second predetermined amount to provide a modified junction voltage reference prior to combining the modified reference voltage and the modified junction voltage reference to produce the output voltage reference.

18. The voltage reference circuit of claim 17, wherein the summation network further comprises:

a divider circuit coupled to the buffer, for dividing the junction voltage reference to provide a divided reference;

a multiplier circuit coupled to the voltage generator, for multiplying the reference voltage to provide a multiplied reference; and a summation circuit coupled to the divider circuit and the multiplier circuit, for summing the divided reference and the multiplied reference to produce the voltage reference.

19. A voltage reference circuit comprising:

a voltage generator for producing a reference voltage which varies in magnitude proportional to temperature;

a forward biased bipolar junction voltage reference circuit for producing a junction voltage reference; and a summation network coupled to the voltage generator and the forward biased bipolar junction voltage reference circuit, for producing an output voltage reference which is less in magnitude than a bandgap voltage of a bipolar semiconductor junction, by changing the reference voltage by a first predetermined amount to provide an amplified reference voltage and changing the junction voltage reference by a second predetermined amount to provide a modified junction voltage reference prior to combining the modified reference voltage and the modified junction voltage reference to produce the output voltage reference, the summation network further comprising:

a sensing section coupled to the voltage generator and the forward biased bipolar junction voltage reference circuit for producing a first current based on the reference voltage, and a second current based on the junction voltage reference;

a current adder coupled to the sensing section for summing the first current and the second current to produce a total current; and an output section coupled to the current adder for producing the voltage reference based on the total current.

20. The voltage reference circuit of claim 19, wherein the summation network further comprises a plurality of output sections coupled to the current adder, wherein each of the plurality of output sections produces a separate voltage reference based on the total current.

* * * * *